US006342828B1

(12) United States Patent
Hagemeister et al.

(10) Patent No.: US 6,342,828 B1
(45) **Date of Patent: *Jan. 29, 2002**

(54) RESISTOR WHICH IS DESIGNED IN THE FORM OF A COLUMN AND IS RESISTANT TO HIGH CURRENT IN PARTICULAR A VARISTOR ON A METAL-OXIDE BASE, AND METHOD FOR PRODUCING SUCH A RESISTOR

(75) Inventors: Michael Hagemeister, Zürich; Wolfgang Kluge, Baden-Dättwil; René Rudolph, Zürich; Claus Christian Schüler, Widen, all of (CH)

(73) Assignee: Asea Brown Boveri AG, Baden (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/001,629

(22) Filed: Dec. 31, 1997

(30) Foreign Application Priority Data

Jan. 16, 1997 (DE) ..... 197 01 243

(51) Int. Cl.[7] ..... H01C 7/10; H01C 7/13
(52) U.S. Cl. ..... 338/20; 252/518; 29/610.1
(58) Field of Search ..... 338/20, 21, 223, 338/224; 361/127; 252/518, 519, 520; 29/610.1, 610.2

(56) References Cited

U.S. PATENT DOCUMENTS 3,753,198 A 8/1973 Shimizu ..... 338/20
3,806,765 A * 4/1974 Matsuoka et al. ..... 317/61
4,069,465 A * 1/1978 Kouchich et al. ..... 338/20
4,296,002 A * 10/1981 Sokoly et al. ..... 252/518
4,377,541 A * 3/1983 Bobik ..... 264/56
4,638,284 A * 1/1987 Levinson ..... 338/21
4,943,795 A * 7/1990 Yamazaki et al. ..... 338/21
5,231,370 A * 7/1993 Arnold, Jr. et al. ..... 338/21
5,387,432 A * 2/1995 Alim et al. ..... 427/101

FOREIGN PATENT DOCUMENTS

DE 4119984 A1 12/1992
EP 0196370 A1 * 10/1986

OTHER PUBLICATIONS

"Surge Arresters: Part 4: Metal–oxide surge arresters without gaps for a.c. systems", International Standard, Commission Electrotechnique Internationale, 1991.

* cited by examiner

*Primary Examiner*—Karl D. Easthom
*Assistant Examiner*—Kyung S. Lee
(74) *Attorney, Agent, or Firm*—Burns, Doane, Swecker & Mathis, L.L.P.

(57) ABSTRACT

The resistor is designed in the form of a column and has a cylindrical resistor body which is arranged between two planar electrodes, aligned parallel, and is made of a ceramic material. The resistor is preferably a varistor on a metal-oxide base, and is then used as a voltage-limiting element in an overvoltage suppressor. The strength of the ceramic material and the length of the resistor are chosen to be as great as possible. However, the length of the resistor is at most sufficiently large that damage to the ceramic resistor body caused by thermally produced pressure waves is avoided when the resistor is loaded in an electrical field of given magnitude with at least one highly energetic current pulse of defined amplitude, form and duration.

5 Claims, 2 Drawing Sheets

RESISTOR WHICH IS DESIGNED IN THE FORM OF A COLUMN AND IS RESISTANT TO HIGH CURRENT IN PARTICULAR A VARISTOR ON A METAL-OXIDE BASE, AND METHOD FOR PRODUCING SUCH A RESISTOR

BACKGROUND OF THE INVENTION

1. Field of the Invention

The invention is based on a resistor which is designed in the form of a column, according to the preamble of patent claim 1 . The invention also relates to a method for producing such a resistor.

A resistor of this type is used for measurement, protection or control tasks in medium- or high-voltage systems. In general, this resistor is designed as a non-linear resistor (varistor) and has a cylindrical resistor body which is arranged between two electrodes, aligned parallel, and is made of a ceramic material. The ceramic material in general comprises a zinc oxide doped specifically with chosen elements, such as Bi, Sb, Co and Mn, and is produced by dense sintering of a pressed body at temperatures between 1000 and 1300° C.

The varistor is preferably used in overvoltage suppressors and must be specified such that it can carry, without damage, current pulses of 65 or 100 kA produced by lightning strikes or switching operations. Such current pulses are applied in the course of the manufacturing process to the electrodes of the varistor in order to check their resistance to high current. The amplitude, the form and the duration of typical current pulses and apparatuses for carrying out tests with such current pulses are described, for example, in IEC Standard 99-4, Part 4: Metal-oxide surge arresters without gaps for a.c., first edition 1991-11, Bureau Central de la Commission Electrotechnique Internationale [Central Bureau of the International Electrotechnical Commission], Geneva, Switzerland.

2. Discussion of Background

A resistor of the type mentioned initially is specified in EP 0 196 370 A1. This resistor has a cylindrical, ceramic resistor body on a doped zinc-oxide base. The mutually parallel, planar end surfaces of the resistor body are metallized and are connected in DC terms to two connecting fittings, one of which is connected to high-voltage potential and the other to earth potential. The resistor is part of an overvoltage suppressor having only one resistor. Since this resistor is fitted with the connecting fittings, there is no need for a suppressor housing. The resistor has a length which is considerably greater than its diameter and can thus be loaded directly with voltages of more than 10 kV. However, if high-current pulses produced by a lightning strike or switching operations then occur, then it is not possible to preclude failure of the resistor and thus of the overvoltage suppressor as well.

SUMMARY OF THE INVENTION

Accordingly, one object of the invention as it is specified in patent claims 1 and 4 is to provide a novel resistor of the type mentioned initially which is distinguished by great length and in which, after loading with high-energy current pulses, failure can reliably be precluded, and to specify a method using which such a resistor can be manufactured in a simple and cost-effective manner.

The resistor according to the invention has a great length with a relatively small diameter and can be loaded with highly energetic current pulses without the strength of its ceramic material being exceeded. This prefabrication of the resistor, which is advantageous for cost-effective manufacture of a device containing the resistor, preferably an overvoltage suppressor, is based on the effect that a thermal impulse caused by a highly energetic current pulse leads to sudden heating of the ceramic material. The ceramic material when heated in a pulsed manner expands thermally to a large extent. To do this, it requires a time period governed by the speed of sound in it. If this time period is in the order of magnitude of the duration of the current pulse, then severe stresses are formed in the ceramic which, in a long resistor, form tensile forces which act predominantly in the axial direction and exceed the strength of the ceramic material beyond a specific resistor length. Thus, for a given ceramic material strength and a given pulse load, the length of the resistor must not exceed a specific value. Since the thermal effects of the current pulse are in general reduced as the volume of the resistor increases, the resistor may be made longer with increasing diameter for the same pulse load.

A preferred method for producing a resistor according to the invention is distinguished by the following method steps:

A characteristic graph is determined for resistors made of the same ceramic material and with the same diameters, but with different lengths.

Mechanical stresses produced in the ceramic material by loading it with at least one highly energetic current pulse are shown on the characteristic graph as a function of the length of the resistors.

A given electrical field strength and at least one current pulse of defined amplitude, form and duration are assigned as electrical parameters to each characteristic.

Sample resistors designed and dimensioned in a corresponding manner to the resistors on the characteristic graph are loaded with the electrical parameters assigned to a characteristic.

Finally, after being loaded with the electrical parameters, the sample resistors are analyzed for their re-usability.

When this method is carried out in practice, two sample resistors of different length must be assigned to one of the characteristics, one of which is intact and a second is defective after being loaded with the electrical parameters, and the strength of the ceramic material must furthermore be entered as a normalization variable between the two sample resistors, and an area of the characteristic graph underneath the normalization magnitude must then be chosen in order to define a mechanical stress capacity which is still permissible, and thus to define a length which is still permissible for the resistor which can be loaded with the electrical parameters.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings.

DESCRIPTION OF THE PREFERRED EMBODIMENTS

Figure 1:
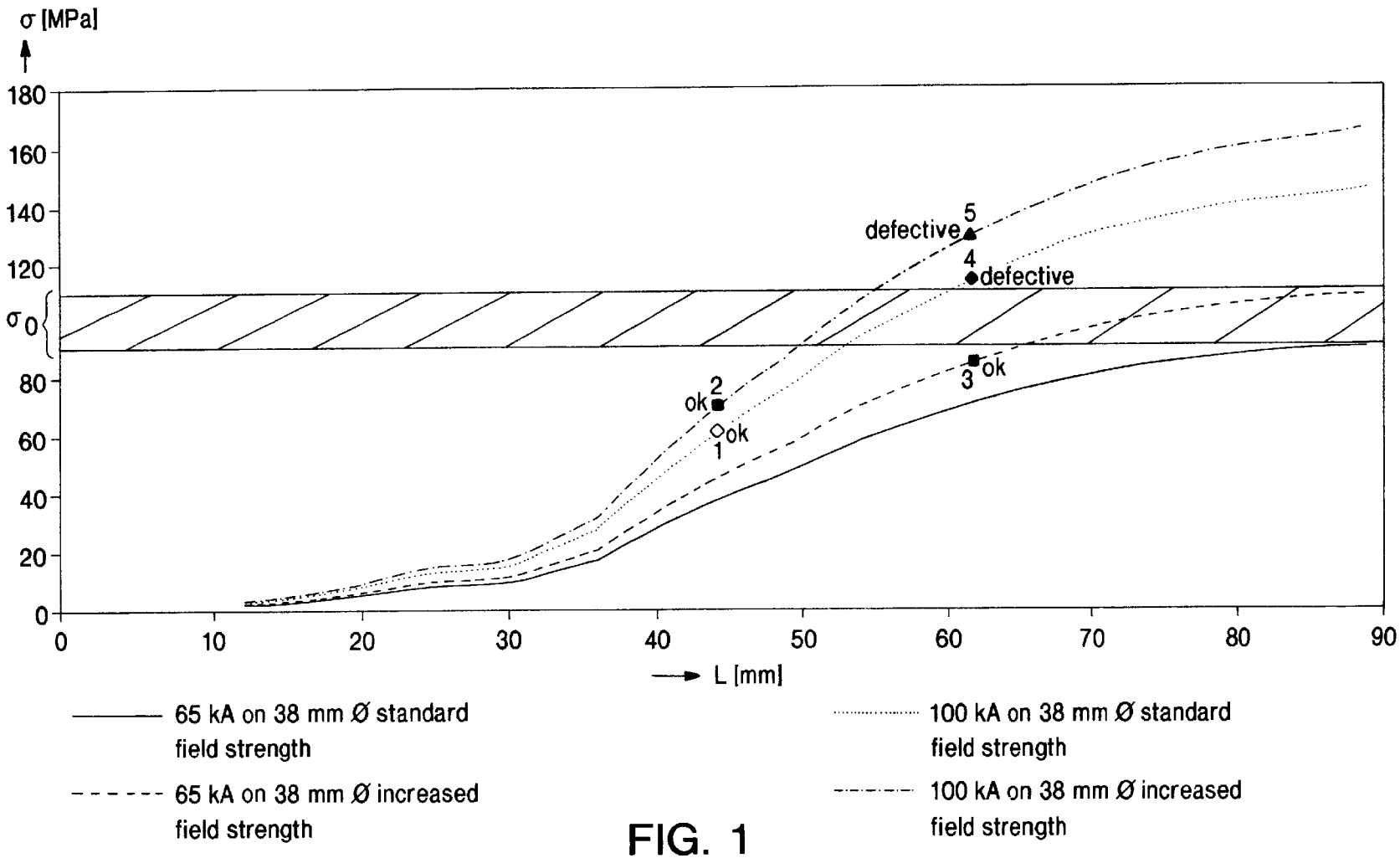
FIG. 1 shows a characteristic graph indicating tensile forces resulting in resistors having given diameters and lengths when current pulses having given durations, amplitudes, and electrical field strengths are applied to the resistors.

Referring now to the drawing, FIG. 1 shows a diagram in which tensile stresses $\sigma$[MPa] which occur in sample resistors, which are designed in the form of a column, because of a pulse-like current wave, are illustrated as a function of the length L [mm] of the sample resistors.

The sample resistors whose characteristic behavior is shown in FIG. 1 were produced as follows:

About 97% molecular weight ZnO, about 0.5% molecular weight $Bi_2O_3$, about 1.0% molecular weight $Sb_2O_3$, about 0.5% molecular weight $Co_2O_3$, about 0.5% molecular weight $MnO_2$ and about 0.5% molecular weight $Cr_2O_3$ were mixed in a ball mill and were milled to form a homogeneous powder mixture with particle diameters between about 1 and about 5 $\mu$m. The powder mixture was suspended in distilled water. In order to reduce the viscosity of the sludge, which amounted to about 60% by weight, about 1% by weight of a low-alkali liquefier was added. Furthermore, about 1% by weight of an organic binder was added in order to improve the plasticity of the subsequent dry mass.

The sludge was now converted in a spray drier to a dry granulate that could be poured. The average size of the grains produced in this way was about 100 $\mu$m. Cylindrical pressed bodies with a diameter of about 47 mm and a length of about 59 mm and 80 mm were formed from the granulate uniaxially in hollow-cylindrical metal molds and isostatically in hollow-cylindrical, elastic molds, using a pressure of about 100 MPa in each case. These pressed bodies were sintered at a temperature of about 1200° C. for about 2 h to form cylindrical resistor bodies designed in the form of a column and having a diameter of 38 mm and a length of 46 mm or 64 mm, and these were provided at the ends with aluminum electrodes, by flame spraying or by arc deposition.

Material samples of the ceramic material of the resistor body with dimensions 4×3×45 $mm^3$ were cut out of a plurality of the sample resistors manufactured in this way. Bending tests were carried out on these sample bodies. From these bending tests, the ceramic material was determined to have a mean ultimate strength of about 100±10 MPa.

The remaining sample resistors were each loaded in a pulsed manner in a test apparatus with two 4/10 $\mu$s current waves with an amplitude of 65 and 100 kA, respectively, with electrical field strengths of about 500 V/mm and about 600 V/mm, respectively. After this, the sample resistors were examined visually. Furthermore, fracture pictures were produced of the sample bodies.

The results obtained from this are shown in the following table and are plotted on the abovementioned diagram.

| Sample | Diameter [mm] | Length [mm] | Condition | Field strength [V/mm] | Current pulse |
|---|---|---|---|---|---|
| 1 | 38 | 46 | satisfact. | 500 | 2 × 4/10 $\mu$s/100 kA |
| 2 | 38 | 46 | satisfact. | 600 | 2 × 4/10 $\mu$s/100 kA |
| 3 | 38 | 64 | satisfact. | 500 | 2 × 4/10 $\mu$s/65 kA |
| 4 | 38 | 64 | defective | 500 | 2 × 4/10 $\mu$s/100 kA |
| 5 | 38 | 64 | defective | 600 | 2 × 4/10 $\mu$s/100 kA |

From simulation calculations, four characteristics were determined, which are plotted on the diagram as solid, dashed, dotted and dashed-dotted lines. In these characteristics, the stress load $\sigma$ which occurs in the ceramic material in response to thermally induced pressure waves when the sample resistors are loaded in a pulsed manner is illustrated as a function of the length L of the resistors. The model calculations were based on the fact that the application of a highly energetic current pulse T has the same effect as a uniform pressure field p(t) applied to the surface of the sample resistors, whose dependency on the time t is governed by the equation shown below:

$$p(t)=-[(E\cdot\alpha/(1-2\cdot v)]\cdot(T_{av}(t)-T_0),$$

where E is the modulus of elasticity, $\alpha$ is the linear coefficient of thermal expansion, v is Poisson's constant, $T_0$ is a reference temperature and $T_{av}$ is the thermal impulse T averaged in three dimensions over the resistor.

The flank gradient and the amplitude of the thermal impulse $T_{av}(t)$ were determined such that they correspond to the thermal effect of the 4/10 $\mu$s/65 kA and 4/10 $\mu$s/100 kA current waves in the sample resistors. A time of about 20 $\mu$s was assumed for the flank gradient of the thermal impulse, and a temperature of 100° C. was assumed for its amplitude at a field strength of 500 kV/mm and a current level of 100 kA. The resistors which absorb the simulated pulse had the same dimensions and material data as the sample resistors, that is to say a diameter of 38 mm, a density of 5.6 g/cm, a linear coefficient of thermal expansion of $5.5\times10^6$ $K^{-1}$ and a modulus of elasticity of $1.10\times10^{11}$.

The pressure field is negative and induces the tensile forces $\sigma$ which are indicated on the diagram and, as can be seen, increase as the length L of the sample resistors increases. As long as these tensile forces are less than the strength $\sigma_0$ of the ceramic material, no defects occur in the ceramic material.

The condition of the sample resistors after the pulsed load with the current waves is entered in the characteristics. It can be seen from this that sample resistors having a given diameter which are loaded in a pulsed manner with a severe current wave must not exceed a specific length since, otherwise, a stress load occurs which exceeds the strength $\sigma_0$ of the resistors and leads to a defect (preferably fracture transversely with respect to the electrodes) of the resistors.

The mechanical stress capacity $\sigma_0$ of the resistors is thus also shown in the diagram. This capacity is defined for calibration purposes such that it occurs between the defective and non-defective sample resistors. It is now possible to see in a simple manner from the diagram the length that a resistor to be manufactured should have for a specific pulse load. For example, an 80 mm long resistor with a diameter of 38 mm should be loaded in a pulsed manner only with a 4/10 $\mu$s/65 kA current wave with a standard electrical field strength (500 V/mm). If, in contrast, it is intended to load a resistor in a pulsed manner with a 4/10 $\mu$s/100 kA current wave in an increased electrical field strength (600 V/mm), then, with a diameter of 38 mm, the resistor may have a length of, at most, 50 mm. This upper limit length which can still be tolerated and is governed by a given pulse load and a given strength of the ceramic material must not be exceeded by the resistor to be produced since, otherwise, it is not possible to preclude damage. In order to prevent such damage particularly effectively, it is recommended that the length of the resistor be chosen to be up to 50%, preferably up to 30%, less than the limit length.

Figure 2:
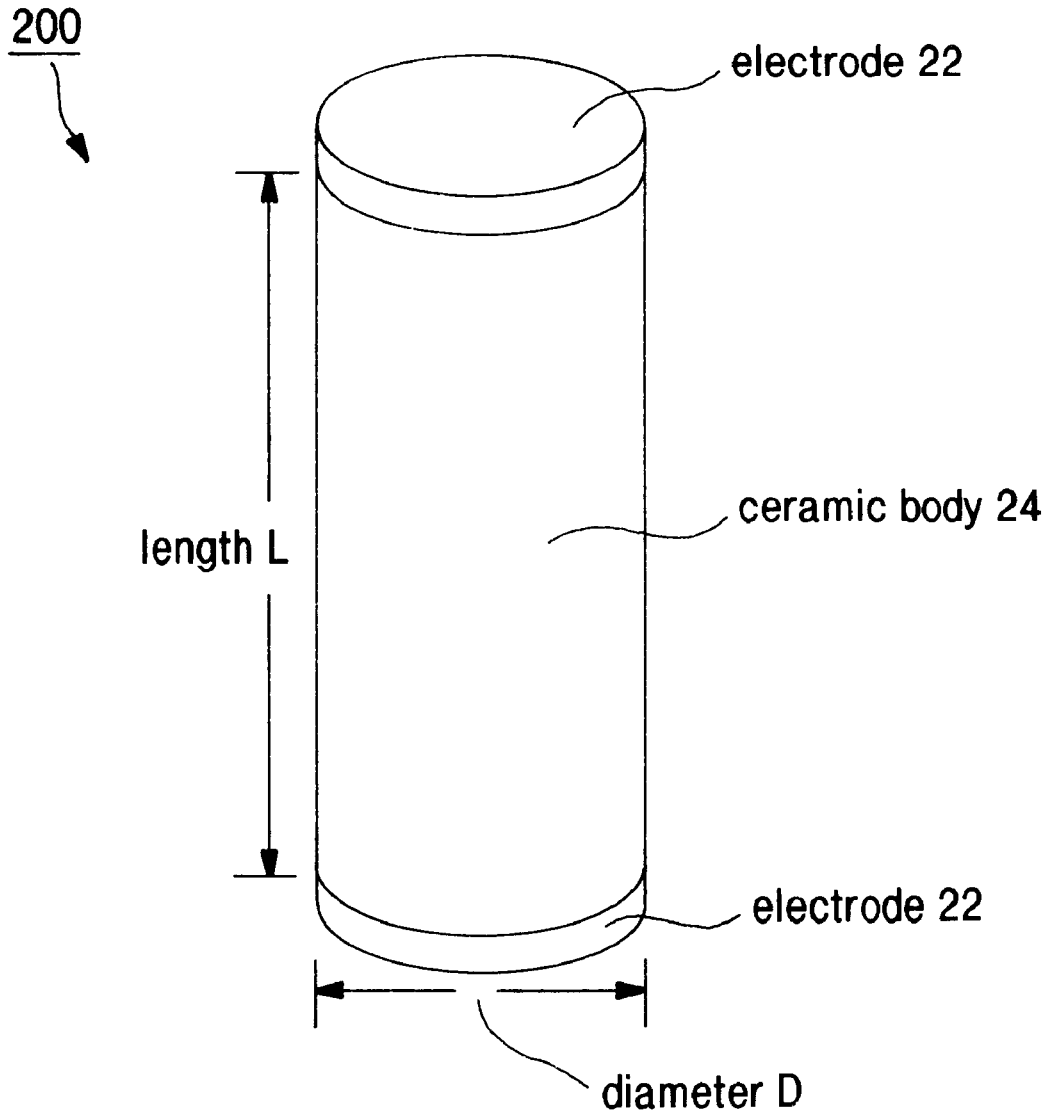
FIG. 2 shows a resistor in accordance with an exemplary embodiment of the invention.

The length of the resistor is preferably greater than its diameter. Overvoltage suppressors which can be used in the voltage range between 5 and 50 kV then require only a single resistor (varistor on a metal-oxide base) and can then be manufactured particularly cost-effectively. With diameters of between 35 and 45 mm, the length of the varistor should then be about 1.3, and at most 1.7, times its diameter. Increasing the diameter for the same length improves the pulse capacity of the resistor at the expense of economy since the energy introduced into the resistor body by the current pulse is better distributed in the mass, which is now greater, of the ceramic resistor body. FIG. 2 shows a resistor 200 in accordance with an exemplary embodiment of the invention, whose length L and diameter D are selected in accordance with the principles described above. The resistor 200 includes a ceramic body 24. The ceramic body can be made of, for example, a sintered ceramic on a spray-dried metal-oxide powder base, as described further above. The resistor 200 is also provided with planar electrodes 22 that are parallel.

Obviously, numerous modifications and variations of the present invention are possible in the light of the above teachings. It is therefore to be understood that, within the scope of the appended claims, the invention may be practiced otherwise than as specifically described herein.

What is claimed as new and desired to be secured by Letters Patent of the United States is:

1. A method for producing a varistor which can be loaded with at least one highly energetic current pulse of defined amplitude, form and duration in an electrical field of a given magnitude, the varistor having a cylindrical resistor body with a defined diameter, made of a ceramic material and arranged between two parallel planar electrodes defining the length of the varistor, in which the ceramic material is formed in a sintering process from a prefabricated pressed body, the method comprising:

determining a characteristic graph for varistors made of the same material and with the same diameters, but with different lengths, in which graph the mechanical stress produced in the ceramic material by loading it with at least one highly energetic current pulse is specified as a function of the length of the varistors, and in which a given electrical field strength and at least one current pulse of defined amplitude, form and duration are assigned as electrical parameters to each characteristic;

loading sample varistors designed and dimensioned in a corresponding manner to the varistors on the characteristic graph, with the electrical parameters assigned to a characteristic, after loading the sample varistors with the electrical parameters, analyzing the sample varistors for their re-usability, determining from the analyzed sample varistors an upper limit length at which damage to the ceramic varistor body is still avoided, and designing the length of the varistor to be produced smaller than the upper limit length.

2. The method as claimed in claim 1, assigning each of at least two sample varistors of different length to at least one characteristic, wherein one of the at least two sample varistors is intact and a second one of the at least two sample varistors is defective after being loaded with the electrical parameters;

entering a strength ($\sigma_0$) of the ceramic material, on the characteristic graph between the at least two sample varistors as a normalization variable;

and choosing areas of the characteristic graph underneath the normalization variable in order to define the mechanical stress capacity which is still permissible, and thus to define the upper limit length which can still be tolerated for the varistor which can be loaded with the electrical parameters.

3. The method as claimed in claim 1, further comprising calculating the characteristic from the time profile of a pressure wave which is formed in the varistor by a thermal impulse T produced by the current pulse.

4. The method as claimed in claim 3, wherein the time profile of the pressure wave is governed essentially by the following equation:

$$p(t)=-[(E\cdot\alpha/(1-2\cdot v)]\cdot(T_{av}(t)-T_0),$$

where E is the modulus of elasticity, $\alpha$ is the linear coefficient of thermal expansion, v is Poisson's constant, $T_0$ is a reference temperature and $T_{av}$ is the thermal impulse T averaged in three dimensions over the resistor.

5. The method of claim 1, wherein the length of the varistor to be produced is selected to be between 50% and 30% less than the upper limit length.

* * * * *